United States Patent [19]

Shamsai

[11] Patent Number: 4,912,896

[45] Date of Patent: Apr. 3, 1990

[54] BEAM/FLOORING SYSTEM

[76] Inventor: Mohammad H. Shamsai, 16 Pengam Street, Kuraby, Queensland, Australia, 4112

[21] Appl. No.: 216,549

[22] Filed: Jul. 8, 1988

[30] Foreign Application Priority Data

Jul. 15, 1987 [AU] Australia ..... PI3126

[51] Int. Cl.[4] ..... E04C 3/10

[52] U.S. Cl. ..... 52/223 R; 52/283; 52/432; 52/259; 52/263

[58] Field of Search ..... 52/223 R, 227–230, 52/283, 438, 227–229, 250–253, 259, 263, 432

[56] References Cited

U.S. PATENT DOCUMENTS

| | | | |
|---|---|---|---|
| 938,458 | 11/1909 | Brockhausen | 52/283 |
| 2,751,776 | 6/1956 | Streblow et al. | 52/227 |
| 3,172,932 | 3/1965 | Vander Heyden | 52/227 |
| 3,283,457 | 11/1966 | Hart | 52/227 |
| 3,918,222 | 11/1975 | Bahramian | 52/263 |

FOREIGN PATENT DOCUMENTS

| | | | |
|---|---|---|---|
| 214618 | 4/1961 | Austria | 52/227 |
| 115457 | 5/1918 | United Kingdom | 52/283 |

*Primary Examiner*—James L. Ridgill, Jr.
*Attorney, Agent, or Firm*—Kimmel, Crowell & Weaver

[57] ABSTRACT

This invention relates to a pre-cast, prestressed hollow core beam unit for use in a two-way building system and is adapted to be supported in continuous spanning relationship on two or more building supports. The beam unit has floor panel supports along opposite edges thereof, and comprises an elongate, continuous body of pre-cast, prestressed concrete having a plurality of hollow cores extending longitudinally throughout its length, with the hollow cores being selectively openable through the top surface of the beam unit to vary the design characteristics of the beam unit. In use, at least one of the hollow cores is opened through the top surface of the beam unit along at least a portion of its length, preferably at a point of high stress where the beam rests on a support, for example. Building reinforcing material is secured within the open portion of the beam unit and extends above the top surface of the beam unit to be received in and bonded to a layer of cement or like building material laid over the beam unit and any floor panels supported thereon, defining a composite action, continuous, monolithic beam structure extending continuously between building supports.

10 Claims, 4 Drawing Sheets

BEAM/FLOORING SYSTEM

BACKGROUND OF THE INVENTION (1) Field of the Invention

THIS INVENTION relates to improvements in beam/flooring systems.

(2) Prior Art

Until now, the use of hollow-core prestressed concrete slabs was limited to one-way systems in building construction. Concrete or steel beams, or concrete block or brick walls were used in conjunction with hollow-core slabs as flooring.

SUMMARY OF THE INVENTION

It is an object of the present invention to show how hollow-core slabs can be used as structural beams to provide a two-way system.

It is a preferred object of the present invention to show how a single such slab can be modified to suit the specific requirements of the builder.

It is a further preferred object of the present invention to minimise the need for on-site formwork and props.

Other preferred objects of the present invention will become apparent from the following description.

In one aspect the present invention resides in a prestressed concrete, hollow-core, building beam unit, arranged to be supported by two or more building supports, wherein the beam unit includes:

a plurality of hollow-cores extending longitudinally within the beam unit;

at least one portion of at least one of the hollow-cores is open to the top surface of the beam unit; and building reinforcement material is secured within the open portion or portions of the beam unit and extends above the top surface of the beam unit to be received in and bonded to a layer of cement or like building material laid over the beam unit.

In a second aspect the present invention resides in a method of building construction including the steps of:

casting a prestressed concrete building beam unit having at least one hollow-core extending longitudinally within the beam unit;

opening at least one portion of at least one of the hollow-cores to the top surface of the beam unit;

securing building reinforcement material within the open portion or portions of the beam unit, the material extending above the top surface of the beam unit;

supporting the beam unit on one or more supports; and laying a layer of concrete or like building material over the beam unit, the building reinforcement material being received in and bonded to the layer of concrete.

Preferably the open portions of the cores are provided at or adjacent both ends of the beam unit. Preferably the cores are opened shortly after the casting of the beam unit, while the concrete is still green.

Preferably the reinforcing material includes one or more ligatures which are secured in the open portions of the hollow-cores by back-filling the open portions with concrete, the concrete preferably being compacted.

Preferably flooring slabs are arranged to span between, and be supported by, a pair of the beam units arranged in parallel. The ends of the flooring slabs may be provided with integral flange members to overlie, or be engaged in sockets along, the sides of the beam units or the ends of the flooring slabs may be provided with steel support flanges to overlie or engage the sides of the beam units.

Preferably reinforcing steel, e.g. rods and/or mesh, are laid over the beam units (e.g. at a column) and the beam units and flooring slabs before the concrete layer is laid.

BRIEF DESCRIPTION OF THE DRAWINGS

To enable the invention to be fully understood, a number of preferred embodiments will now be described with reference to the accompanying drawings, in which.

DETAILED DESCRIPTION OF THE PREFERRED EMBODIMENTS

Figure 1:
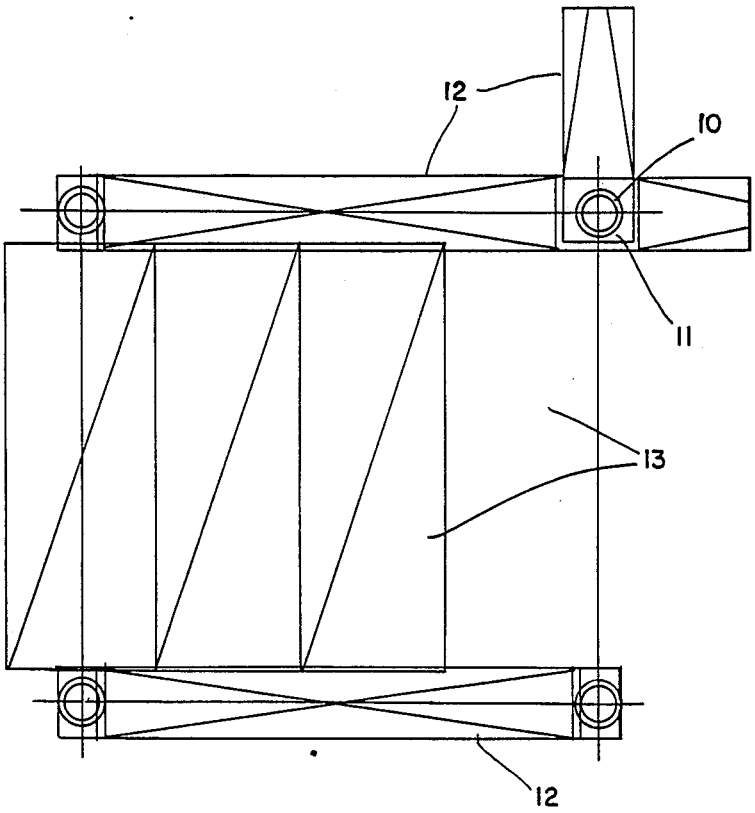
FIG. 1 is a plan view of a typical bay in a building using the beam units of a first embodiment of the invention.
Figure 2:
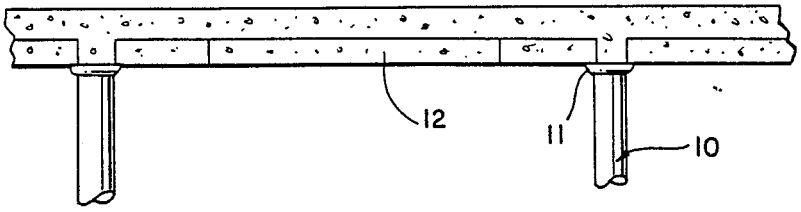
FIG. 2 is a side view of the bay.
Figure 3:
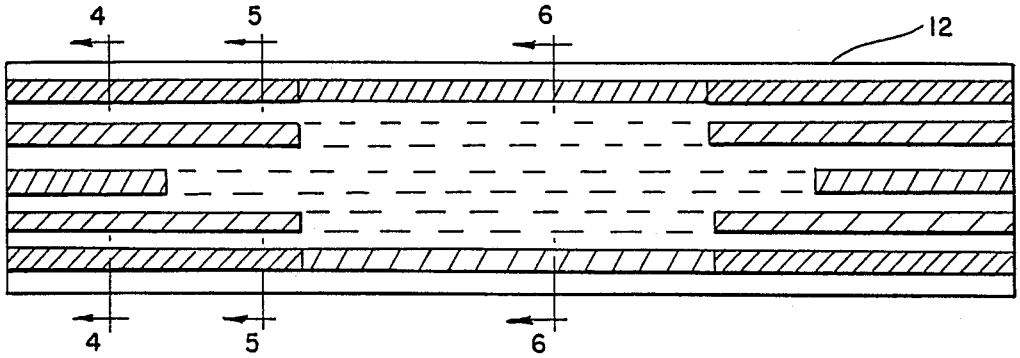
FIG. 3 is a plan view of a typical beam unit of the first embodiment, the hollow-cores being indicated by dashed lines, the open portions of the cores provided with reinforcing ligatures and backfilled with concrete being indicated by the hatched areas.

Referring to FIGS. 1 to 8, columns 10, provided with corbels 11, are provided at predetermined modular distances over the building site.

Prestressed concrete hollow-core beam units 12, to be described hereinafter in more detail, are suported at each end by a respective pair of columns 10, and intermediate their length by removable props, to provide a structural member between the columns. Floor panels 13, also of prestressed concrete, are then laid transversely to the beam units 12 to be supported thereby.

Suitable reinforcing rods and/or mesh 14 are provided at the junction between the beam units 12, and the beam units 12 and floor panels 13, and the concrete 15 is laid over the beam units and slabs to complete the floor. As will be readily apparent to the skilled addressee, the beam units and floor panels provide in-situ formwork for the concrete, and when the concrete sets, become "locked" into the floor structure.

Referring to FIGS. 3 to 6, each beam unit 12 is cast from prestressed concrete and has a plurality e.g. five hollow-cores 16 extending longitudinally within the length and the unit.

Before the concrete has set, openings are cut into the top surface 17 of the units to provide access to the one or more of the hollow-cores 16. As shown in FIGS. 3 to 6, both of the outer cores 16*a* may be opened for their full length, the intermediate cores 16*b* for e.g. one-quarter of their length and the central core 16*c*, e.g. for approximately one-third its length.

Reinforcing ligatures 18 are positioned in the openings in the cores 16 and extend above the top surface 17 of the beam unit. Concrete 19 is placed in the open-cores, to back-fill them, and this concrete is compacted and when set, secures the ligatures 18 in the beam units.

Figure 4:
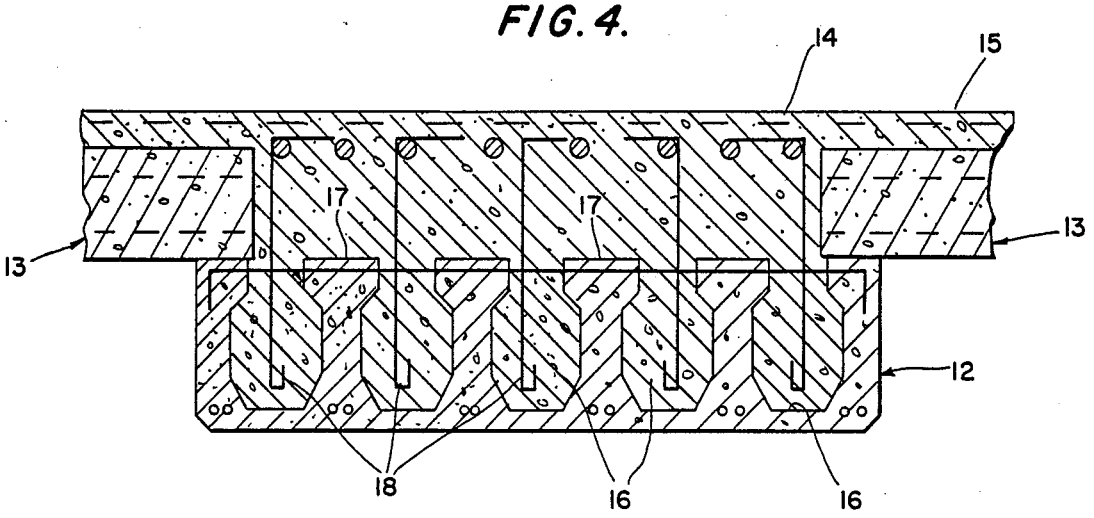
FIGS. 4, 5 and 6 are respective sectional end views taken on lines 4, 5 and 6 respectively, on FIG. 3 showing the junction between a beam unit and two floor slabs.
Figure 5:
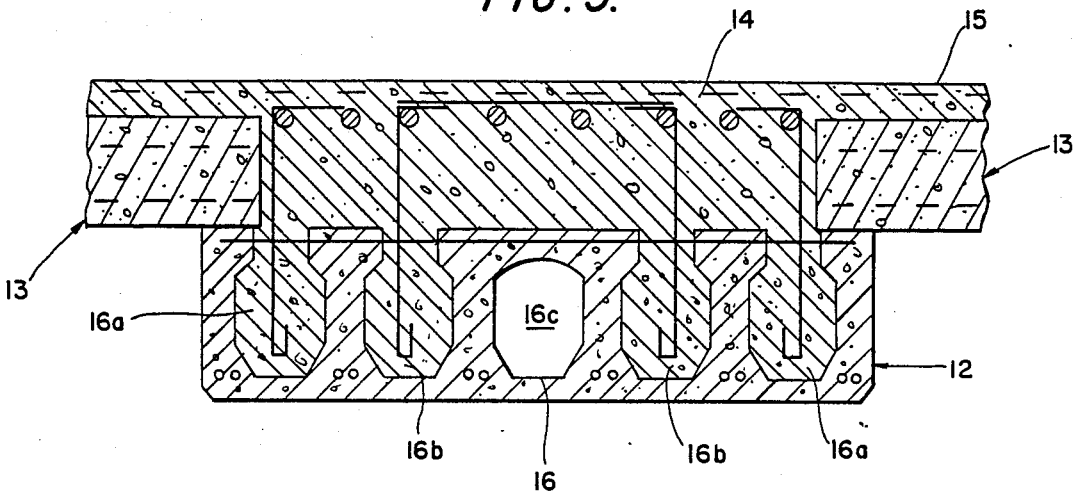
Figure 6:
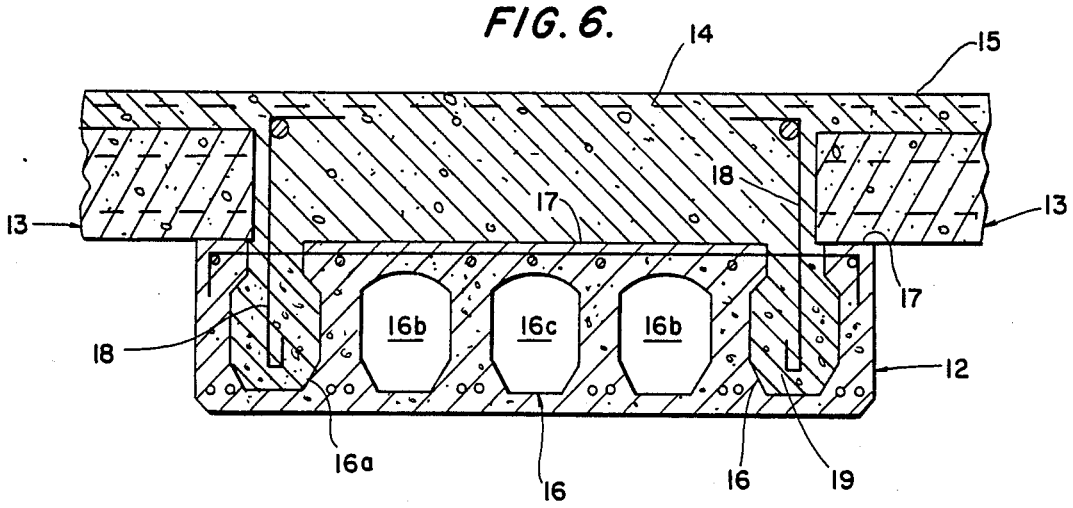

As shown in FIGS. 4 to 6, the highest density of ligatures is provided at the ends of the beam units 12 to provide the greatest shear resistance of the columns.

When the beam units 12 and floor panels 13 have been positioned and the reinforcing steel 14 positioned, the cavity formed above the columns 10 is filled with concrete before a final topping layer is laid over the complete floor.

Figure 7:
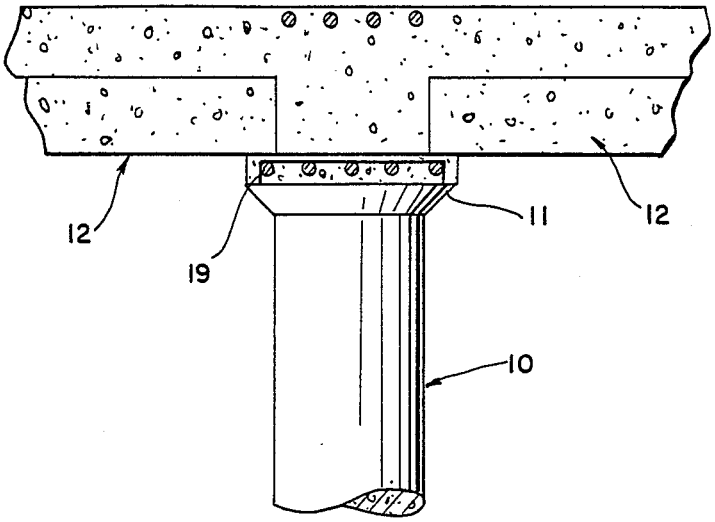
FIG. 7 is a side view showing two beam units supported by a column with a corbel.
Figure 8:
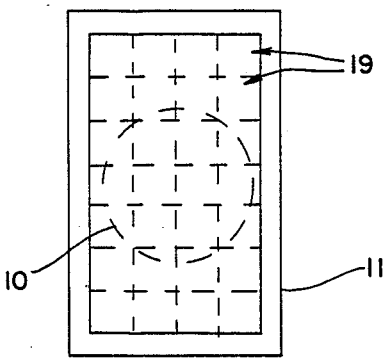
FIG. 8 is a plan view showing the reinforcement in the corbel.

Referring now to FIGS. 7 and 8, these show the arrangement of the reinforcing steel 19 in the corbel 11 of the columns 10 used to support the beam units.

By varying the depth (and width) of the beam units 12, the engineers can ensure that the floor, when completed, will support the designed structural loads.

As the beam units 12 support the floor panels 13 before and during casting, and the combination provides in-situ formwork for the concrete laid over them, few supporting props are required and the need for formwork is avoided.

Figure 9:
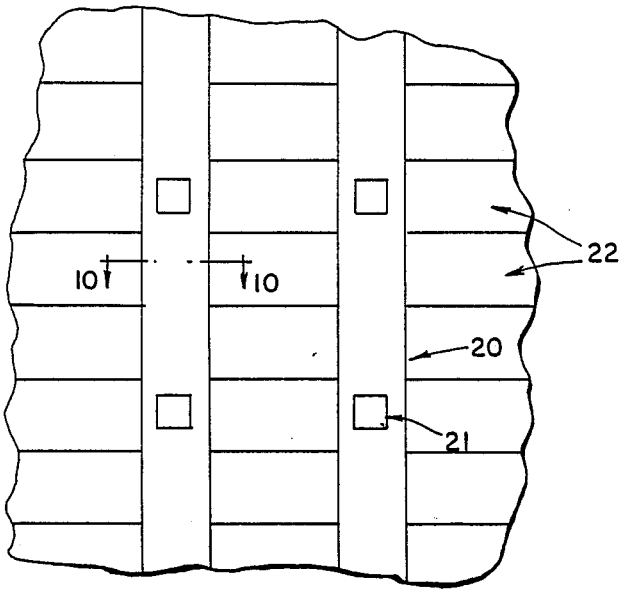
FIG. 9 is a plan view of a second embodiment which enables a single thickness floor to be constructed.
Figure 10:
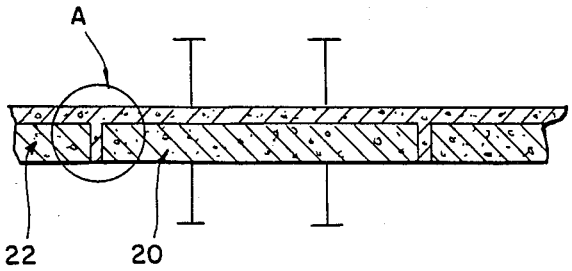
FIG. 10 is a sectional end view taken on line 10 on FIG. 9.
Figure 11:
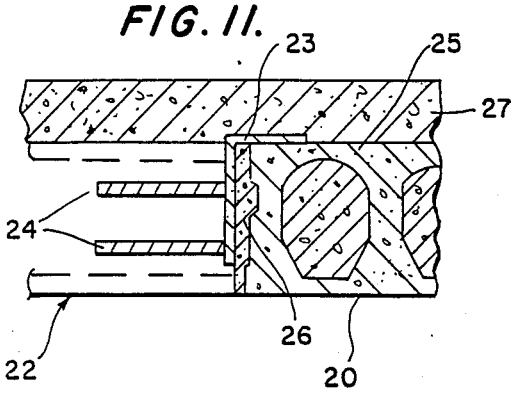
FIG. 11 shows the detail A in FIG. 10 on a larger scale.

Referring now to FIGS. 9 to 11, a floor of uniform thickness may be required. Referred to FIG. 9, the beam units 20, generally of the same construction as for beam units 12, are supported on columns 21 in the manner hereinbefore described.

The floor panels 22 are of the same thickness as the beam units 20 but do not overlie them e.g. as shown in FIG. 4. L-shaped flanges 23 are provided across each end of the floor panels 22 and are secured thereto by suitable anchors 24. As shown in FIG. 11, the flanges 23 bear on the top surfaces 25 along each side of respective supporting beam units 20 and the gap between the floor panel end and adjacent beam unit side is filled with cement 26. A topping layer of cement 27 is then laid over the beam units 20 and floor panels 22 to complete the floor.

Figure 12:
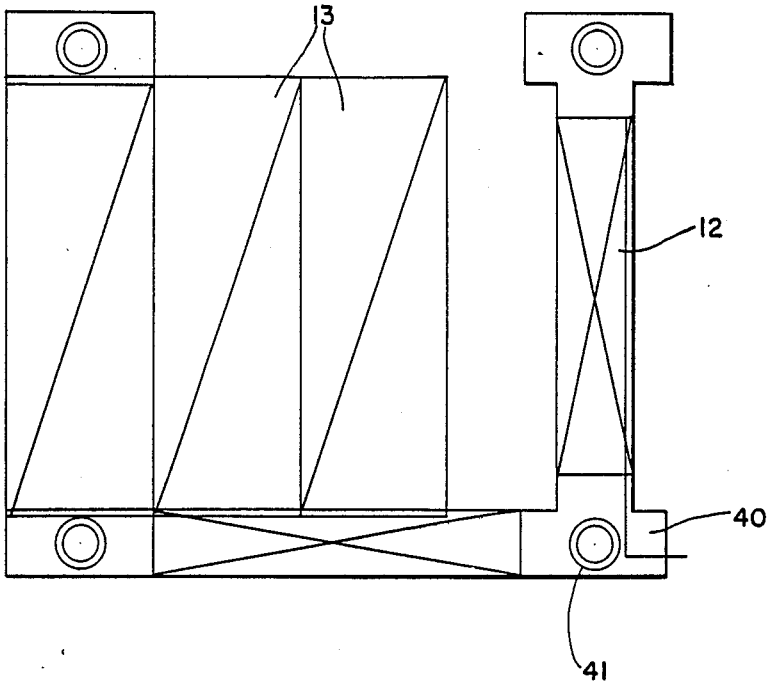
FIG. 12 is a plan view of a third embodiment where the beam units are supported on column capitols.

Referring now to FIG. 12, the beam units 12 may be supported on column capitols 40 on the columns 41, and the floor panels 13 are laid and floor completed as hereinbefore described. The column capitols allow the overall height of the building to be reduced as the beam units 12 are on the same horizontal plane as the capitols 40.

Figure 13:
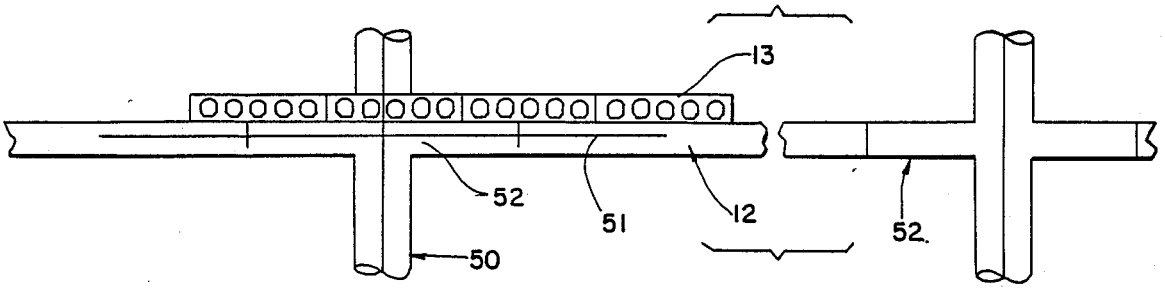
FIG. 13 is a side view of a fourth embodiment where the beam units are supported by columns cast in-situ.
Figure 14:
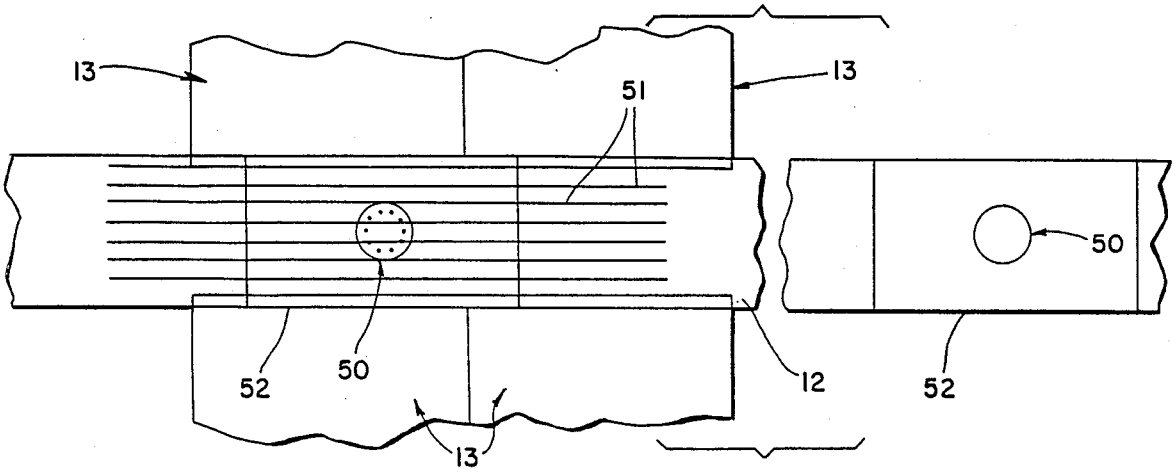
FIG. 14 is a plan view of the reinforcing at the columns.

Referring now to the embodiment of FIGS. 13 and 14, this enables the columns 50 to be cast in-situ after the beam units 12 and floor panels 13 have been positioned, supported on temporary supports or props.

The beam units 12 are arranged in the desired layout and are supported by suitable props and then the floor panels are laid over them. The formwork for this column is erected and suitable reinforcing steel rods 51 are arranged to extend through the column capitols 52 and into the hollow-cores of the adjacent beam units 12.

The columns are then cast in-situ and the floor slab is then completed. When the concrete has set, the formwork for the columns and the props are removed, leaving the completed floor.

It will be readily apparent to the skilled addressee that the present invention provides a building construction system where the beam unit provides a two-way system and acts as a structural entity both before and after the floor slab is completed.

Various changes and modifications may be made to the embodiments described without departing from the scope of the present invention as defined in the appended claims.

I claim:

1. A pre-cast, prestressed hollow core beam unit for use in a two-way building system and adapted to be supported in continuous spanning relationship on two or more building supports, comprising:

an elongate, continuous body of pre-cast, prestressed concrete having a relatively wide and flat top surface and a plurality of hollow cores extending longitudinally throughout the length of the beam, said hollow cores being selectively openable through the top surface of the beam unit to vary the design characteristics of the beam unit depending upon the intended use, and at least one portion of at least one of the hollow cores being open through the top surface;

pre-stressed reinforcing means extending longitudinally in a bottom portion of the beam unit;

floor panel support means along at least one side of the beam unit for supporting at least one floor panel extending transversely from the beam unit; and building reinforcing material secured within said at least one open portion of the beam unit and extending above the top surface of the beam unit to be received in and bonded to a layer of cement or like building material laid over the beam unit and any floor panels supported thereon, thus forming a composite action, continuous, monolithic, unitary beam structure extending continuously between said building supports.

2. A hollow core building unit as claimed in claim 1, wherein:

cement or like building reinforcing material fills said open portion of said at least one hollow core and extends in a layer over the flat top surface of the beam unit, bonding in place building reinforcing means extended into the hollow core and projecting upwardly through the open top of the beam unit, imparting a composite action to the beam unit because of the interlock between the open hollow cores and the bond over the relatively wide top surface, whereby the beam unit forms a single monolithic beam structure for spanning between two building support elements.

3. A hollow core beam unit as claimed in claim 1, wherein:

said at least one portion of said at least one of the hollow cores is filled with cement or like building material to secure said building reinforcing material in place.

4. A hollow core beam unit as claimed in claim 2, wherein:

a plurality of said hollow cores are open through the top surface of the beam unit, each having building reinforcing material bonded therein by cement or like building material, said cement or like building material extending over the relatively flat top surface of the beam unit and forming a composite structure by the interlock of the open hollow cores and bonded building material over the relatively wide and flat top surface of the hollow core beam.

5. A hollow core beam unit as claimed in claim 3, wherein:

at least the hollow cores adjacent the opposite sides of the beam unit are open through the top surface of the beam unit along the entire length of the beam unit.

6. A hollow core beam unit as claimed in claim 5, wherein:

the hollow cores spaced between those adjacent the opposite sides of the beam unit are open through the top surface of the beam unit only at the opposite ends of the beam unit.

7. A two-way building construction system including:

a plurality of supporting columns arranged in a predetermined pattern;

a plurality of prestressed, pre-cast, hollow core concrete building beam units, usable in a two-way building system, supported on respective pairs of the columns, said beam units each comprising an elongate, continuous body of pre-cast concrete having a relatively wide and flat top surface and a plurality of hollow cores extending longitudinally throughout the length of the beam, said hollow cores being selectively openable through the top surface of the beam unit so that they can be back-filled with concrete or like building material to vary the design characteristics of the beam unit depending upon the intended use, and including floor panel support beams along at least one side of the beam unit arranged to support at least one floor panel extendable trnasversely from the beam unit, at least one portion of at least one of the cores being open to the top surface of the beam unit, and building reinforcement material secured within the open portion or portions of the beam unit and extending above the top surface of the beam unit to be received in and bonded to a layer of concrete or like building material laid over the beam unit and any floor panel supported thereby; and a plurality of floor panels extending transversely to and supported by respective pairs of parallel beam units.

8. A system according to claim 7, wherein:

a layer of concrete is laid over the beam units and floor panels, which provide in-situ formwork, to complete the floor slab.

9. A system according to claim 7, wherein:

the reinforcing material includes one or more ligatures secured in the open portions by back-filling the cores with concrete.

10. A method of two-way building construction including the steps of:

casting a plurality of prestressed concrete building beam units, each beam unit having floor panel support means along at least one side thereof and having a plurality of hollow cores extending longitudinally throughout the length of the beam unit;

selectively opening at least one portion of at least one of the hollow cores to the top surface of each beam unit;

securing building reinforcement material within the open portion or portions of each beam unit, the material extending above the top surface of the beam unit to achieve a desired load capacity for an intended purpose;

supporting each beam unit on one or more supports;

supporting a plurality of floor panels by the beam units, the floor panels extending transversely to the beam units; and laying a layer of concrete or like building material over the beam units and the floor panels, the building reinforcement material being received in and bonded to the layer of concrete.

* * * * *